United States Patent [19]

Bowling

[11] 4,335,511

[45] Jun. 22, 1982

[54] DRY WALL OUTLET BOX LOCATOR AND CUTTER ASSEMBLY

[76] Inventor: Dan P. Bowling, 2625 Colt Rd., Rancho Palos Verdes, Calif. 90732

[21] Appl. No.: 115,914

[22] Filed: Jan. 28, 1980

[51] Int. Cl.[3] ..... B26F 1/00

[52] U.S. Cl. ..... 30/366; 30/358; 30/367; 33/DIG. 10; 220/3.4

[58] Field of Search ..... 30/358, 366, 367; 33/DIG. 10; 220/3.4

[56] References Cited

U.S. PATENT DOCUMENTS

| | | | |
|---|---|---|---|
| 3,057,053 | 10/1962 | Schlage et al. | 30/366 |
| 3,230,631 | 1/1966 | Skidmore | 30/367 |
| 3,253,730 | 5/1966 | Mount | 220/3.4 |
| 3,786,564 | 1/1974 | Acheson | 30/310 |
| 3,888,068 | 6/1975 | Zambrano | 30/358 |
| 4,096,964 | 6/1978 | Glick | 220/3.4 |

FOREIGN PATENT DOCUMENTS

| | | | |
|---|---|---|---|
| 28256 | of 1913 | United Kingdom | 30/366 |
| 636815 | 5/1950 | United Kingdom | 30/367 |
| 1022767 | 3/1966 | United Kingdom | 30/366 |

*Primary Examiner*—Stephen G. Kunin
*Assistant Examiner*—J. T. Zatarga
*Attorney, Agent, or Firm*—William C. Babcock

[57] ABSTRACT

An assembly for determining the center of a stud or joint supported electrical outlet box on a sheet of dry wall prior to the latter being permanently secured to the studs or joints, and for forming an opening in the dry wall as a result of the determination that will be transversely aligned with the interior of the outlet box when the sheet of drywall is permanently secured to the framing supporting the outlet box.

4 Claims, 14 Drawing Figures

FIG. 1
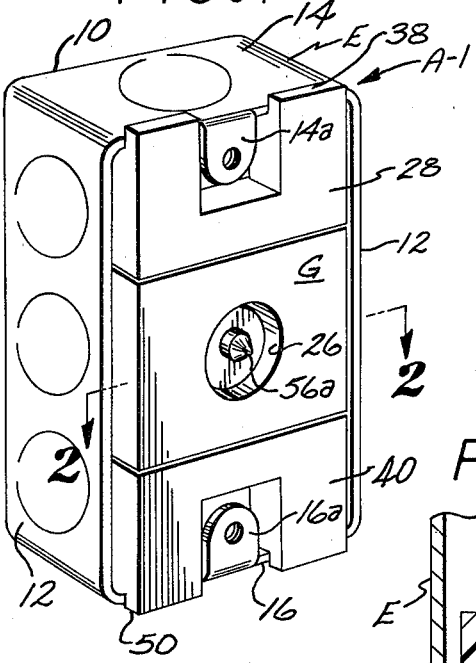
FIG. 2
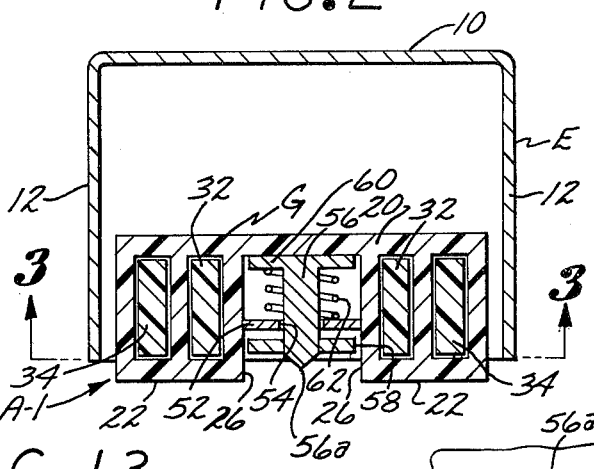
FIG. 13
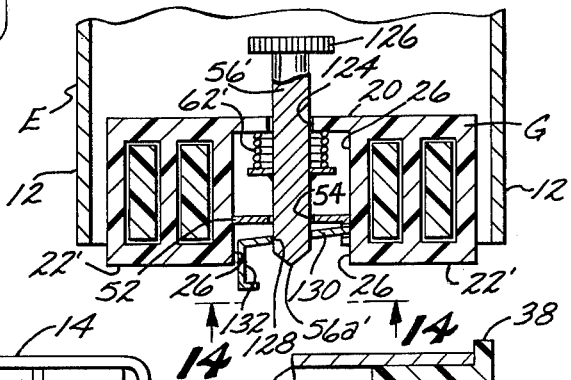
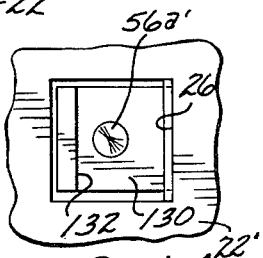
FIG. 14
FIG. 3
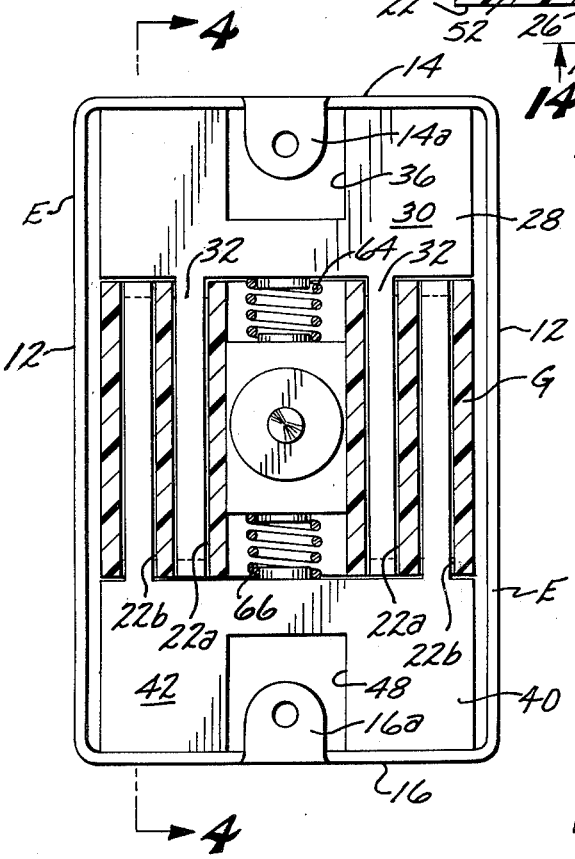
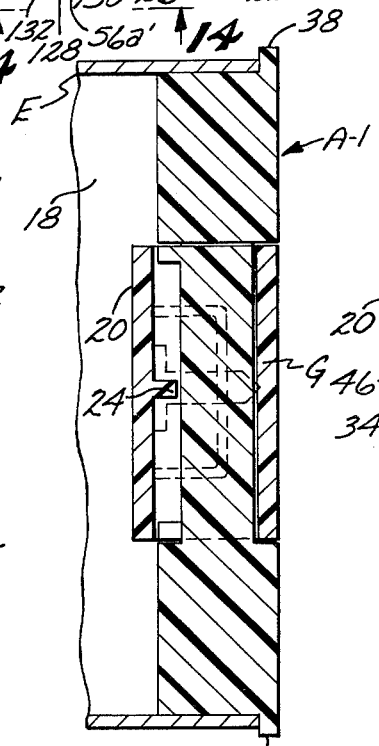
FIG. 4
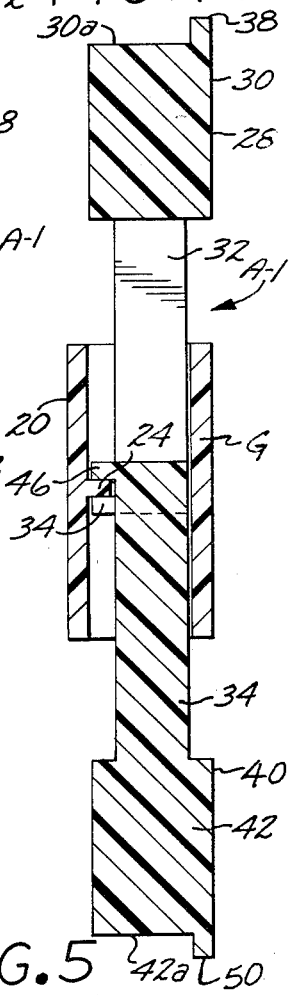
FIG. 5

DRY WALL OUTLET BOX LOCATOR AND CUTTER ASSEMBLY

BACKGROUND OF THE INVENTION

1. Field of the Invention

Dry Wall Outlet Box Locator and Cutter Assembly.

2. Description of the Prior Art

In modern construction practice the electrical outlet boxes and associated conduit is installed in permanent positions in the framing of a building which may be either studs or joists. After such installation sheets of dry wall are permanently secured to the studs or joints. A troublesome problem and one that requires time consuming measurements that may be subject to error is to locate openings in the dry wall sheets that will be transversely aligned with the interiors of the outlet boxes when the dry wall sheets are permanently secured to the framing. Occassionally errors will be made in locating such openings, and the dry wall sheets will either have to be discarded or the positions of the outlet boxes changed to coincide with the erroneously located opening. In either event a substantial amount of time is wasted in correcting the situation and with a substantial expense to the builder or contractor.

A major object of the present invention is to provide an assembly that eliminates the above-mentioned problem by removably inserting a device in the framing supported outlet box that will register the center thereof on a sheet of dry wall when the later is temporarily positioned in the position it will permanently occupy relative to the outlet box, and the center registered on the dry wall sheet serving to align a cutting tool which may be used manually to cut an opening in the dry wall sheet that will be transversely aligned with the interior of the outlet box when the drywall sheet is permanently secured to the framing.

SUMMARY OF THE INVENTION

An assembly comprising a locator that is removably installed in the forward interior portion of a framing supported electrical outlet box that includes a transversely movable centered member that normally occupies a first retracted position. When a sheet of wall board is temporarily disposed to occupy the position it will permanently occupy when nailed or otherwise secured to the framing the transversely movable member is actuated to move outwardly to a second position where it registers the center of the outlet box on the inner surface of the wall board sheet. A bladed cutter forms a second part of the assembly. After the center of the outlet box interior has been registered on the wall board sheet, the sheet is laid on a flat surface. The cutter includes three projecting prongs. The center prong is disposed over the registered center on the wall board, and the cutter is struck a sharp blow to drive the three prongs completely through the wall board and the cutters partially passing through the wall board to outline the opening therein that will be transversely aligned with the outlet box when the wall board is permanently secured to the framing. The sheet of wall board is now turned over with the three prongs inserted in the three openings. The cutter is now struck a second sharp blow for the cutters to pass through the uncut portion of the wall board to merge with the cuts previously made. The core or plug of wall board within the confines of the cuts made by the cutter may now be pushed or knocked out of the sheet of wall board. The sheet of wall board is now nailed or otherwise secured to the framing, with the opening in the wall board sheet being transversely aligned with the interior of the electrical outlet box. By forming outlet box openings in sheets of wall board as above described, the possibility of an opening in the wall board being misaligned with the interior of an electrical outlet box is eliminated.

BRIEF DESCRIPTION OF THE DRAWINGS

FIG. 1 is a perspective view of a framing supported electrical outlet box with a first form of locator removably supported in the forward interior portion thereof;

FIG. 2 is a transverse cross-sectional view of the locator taken on the line 2—2 of FIG. 1;

FIG. 3 is a second transverse cross-sectional view of the locator taken on the line 3—3 of FIG. 2;

FIG. 4 is a longitudinal cross sectional view of the locator mounted in the outlet box and taken on the line 4—4 of FIG. 3;

FIG. 5 is the same view of the locator shown in FIG. 4 but in a fully expanded longitudinal position;

FIG. 10 is a perspective view of a second form of locator particularly adapted for use with ceiling supported outlet boxes;

FIG. 11 is a transverse cross-sectional view of the second form of locator;

FIG. 12 is a cross-sectional view of the second form of locator taken on the line 12—12 of FIG. 11;

FIG. 13 is a transverse cross-sectional view of a third form of locator; and FIG. 14 is a fragmentary end elevational view of the third form of locator taken on the line 14—14 of FIG. 13.

DESCRIPTION OF THE PREFERRED EMBODIMENTS

Figure 6:
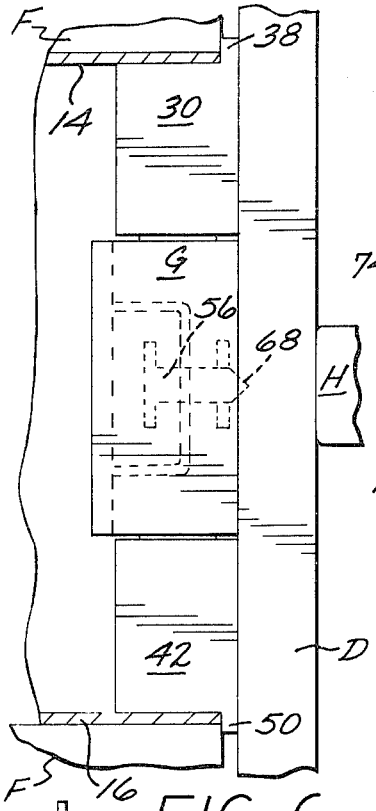
FIG. 6 is a side elevational view of the locator being actuated to register the center of an outlet box on a sheet of wall board that is temporarily disposed to occupy the position it will permanently occupy on stud or joist framing.
Figure 7:
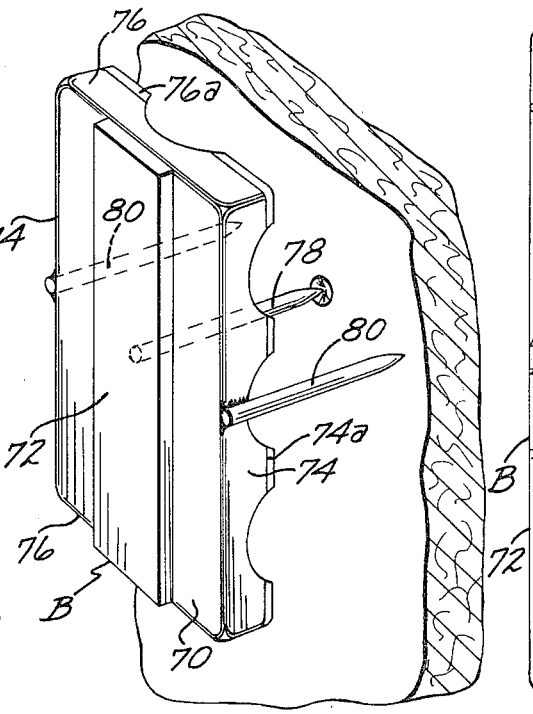
FIG. 7 is a perspective view of the cutter used in forming an opening in a sheet of wall board.
Figure 8:
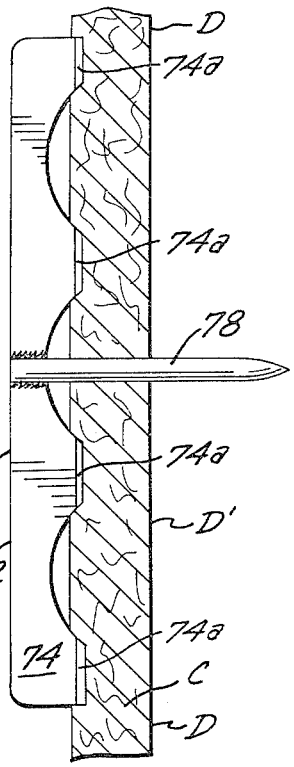
FIG. 8 is a side elevational view of the cutter after the latter has been struck to drive the three prongs thereof through the wall board sheet and the blades to at least partially penetrate the wall board to define the opening that will be formed therein.
Figure 9:
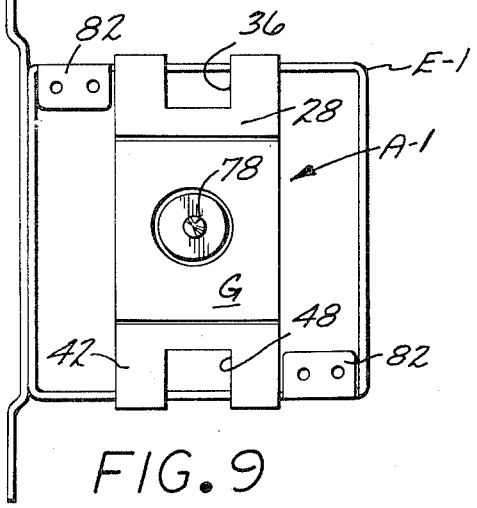
FIG. 9 is a front elevational view of the locator removably mounted in a double electrical outlet box.

The first form of the invention A-1 as shown in FIGS. 1 to 6 is used in conjunction with a cutter B illustrated in FIGS. 7 and 8 as an assembly to locate and form an opening C in a sheet of wall board D in alignment with an electrical outlet box E secured to the framing F of a building (not shown), which framing may include either studs or joists. In using the invention A-1 the wall board sheet D is temporarily disposed adjacent the framing F in the position it will permanently occupy when subsequently secured to the framing, with the invention A-1 then being used to register the center of the interior of the outlet box E on the rearward surface of wall board sheet D. The wall board sheet D is then removed from this position and the cutter B then used to form the opening C in the wall board sheet using the registration as a guide.

The registration effected on the rearward surface of the wall board sheet will normally be an indentation although a mark on the wall board sheet would also serve as a guide to dispose the cutter B in a position to initially sever a part of the wall board sheet D to define opening C. The forming of the opening C is completed by reversing the position of the wall board sheet D and using the cutter B on the reversed side to complete the forming of opening C. After the abovedescribed operation, the wall board sheet D may be disposed in the position it will occupy permanently on the framing F when secured thereto, with the assurance that the opening C will be transversely aligned with the interior of the outlet box E.

The electrical outlet box E is of a design currently in use and is of generally rectangular shape. Outlet box E as may be seen in FIG. 1 includes a back 10, a pair of side walls 12, an upper end wall 14, and lower end wall 16. The end walls 14 and 16 have apertured tabs 14*a* and 16*a* extending towards one another from the forward edges of the end walls as may be seen in FIG. 3, which tabs are used as supports to secure an electric switch (not shown) in a permanent position within the interior 18 of the outlet box E.

The first form of the invention A-1 as best seen in FIGS. 2 to 5 inclusive includes a rigid, non-magnetic connector block G. Connector block G as shown in FIG. 2 includes a rearwardly disposed plate 20 that has a pair of laterally spaced projections 22 extending forwardly therefrom, with pairs of first and second elongate parallel openings 22*a* and 22*b* extending downwardly through the projections as best seen in FIG. 3. A center space 26 is provided between the pair of projections 22 as may best be seen in FIG. 2.

First and second grippers 28 and 40 are operatively associated with the connector block G as may be seen in FIGS. 3, 4 and 5. The first gripper 28 includes a first generally rectangular body 30 that has a flat upper end surface 30*a*. A pair of laterally spaced, parallel, first legs 32 extend downwardly from body 30 and are slidably disposed in the first pair of openings 22*a* as shown in FIG. 2. Plate 20 has an elongate transverse stop 24 extending forwardly from substantially the center thereof. The first pair of legs 32 have lips 34 on the lower ends thereof that contact the stop 24 when the legs move upwardly to their maximum upper position as shown in FIG. 5. A transverse rib 38 extends upwardly from the forward edge of first body 30 as shown in FIG. 4.

The second gripper 40 is identical to the first gripper 28. Second gripper 40 includes a second body 42 that has a pair of laterally spaced parallel legs 44 projecting therefrom that are slidably mounted in the second pair of openings 24*a*. The second pair of legs 44 has a second pair of lips 46 exending outwardly from the upper ends thereof that contact stop 24 when the second pair of legs are in their downwardmost position as shown in FIG. 5. A transverse rib 50 projects outwardly from the end surface 42*a* of second body 42 as best seen in FIG. 5. The first and second bodies 28 and 42 have openings 36 and 48 therein of greater size than the tabs 14*a* and 16*a* as may be seen in FIG. 3.

A non-metallic wall 52 spans the space 26 as may be seen in FIG. 2, which wall has a transverse opening 54 therein in which a prong 56 is slidably mounted. The prong 56 has a forward pointed end 56*a*. A body 58 of soft iron or other magnetically attractable material is mounted on prong 56 adjacent the pointed end 56*a* as may be seen in FIG. 2.

First and second compressed helical springs 64 and 66 are provided that extend away from one another as shown in FIG. 3, which springs abut against the first and second bodies 30 and 42 and at all times tend to move them in opposite directions to the positions shown in FIG. 5. The first and second springs 64 and 66 are secured to upper and lower end portions of wall 52 by conventional means (not shown).

When the first and second grippers 28 and 40 are manually moved inwardly to a minimum distance from one another the first form of the invention A-1 may be inserted into the interior of outlet box E, and the first and second springs 64 and 66 allowed to expand to force the first and second grippers into pressure frictional contact with the interior surfaces of the outlet box end walls 14 and 16 to removably hold the first form of invention A-1 in the outlet box. The sheet of wall board D is now temporarily disposed adjacent the framing F in the position it will occupy permanently when secured to the framing. A powerful permanent or electro magnet H as shown in FIG. 6 is now moved over the exterior surface of the wall board sheet D adjacent the outlet box E. Magnet H due to attracting the body 58 results in the prong 56 being drawn forwardly with the end 56*a* registering an identation or mark 68 on the rearward surface of wall board sheet D, which mark will indicate on the wall board sheet the center of the interior of the outlet box E. The wall board sheet D is now removed, and the first form A-1 of the invention removed from the outlet box E for future use.

The cutter B is in the form of a rectangular box open on one side, and is of substantially the same or slightly less than the transverse area of the interior of outlet box E. Cutter B includes a rectangular back wall 70 that has a heavy rigid metallic strap 72 secured to the exterior surface thereof. A pair of side walls 74 and pair of end walls 76 project outwardly from back 70 in a direction away from strap 72, with the side walls and end walls 74 and 76 on the free edges thereof being ground to define spaced knife edges 74*a* and 76*a* as may be seen in FIG. 7.

A centered prong 78 extends forwardly from back 70. A pair of prongs 80 are situated on opposite sides of prong 78 and also extend forwardly from the back 70, to which the prongs 78 and 80 are secured by conventional means.

The wall board sheet D is now abutted against a supporting structure (not shown) and the prong 78 aligned with the registry indentation 68. The strap 72 is now struck a sharp blow with a hammer (not shown) that causes the prongs 78 and 80 to pass completely through the wall board sheet D as shown in FIG. 8 and the knife edge 74*a* and 76*a* to partially sever the same. The cutter B is now withdrawn from the wall board sheet D and the same operation performed on the opposite side thereof, with the prongs 78 and 80 being inserted in the transverse openings 82 previously made in the wall board. The transverse openings 82 serve as guides for the second operation. After the first and second operations have been completed the portion D' of the wall board with the cut portions as shown in FIG. 8 may be knocked out to provide the opening C. The wall board sheet D may now be permanently secured to the framing F with the assurance that the opening C will be transversely aligned with the interior of the outlet box E.

The first form A-1 of the invention may be used with a double electrical outlet box E-1, for such boxes concurrently in use include laterally spaced tabs 82 between which the invention A-1 may be disposed. The first form A-1 of the invention produces a registered identation 68 that is the center of the double outlet box E-1.

A third form A-3 of the invention is illustrated in FIGS. 13 and 14 that is similar to first form A-1. Elements common to the first form A-1 of the invention in third form A-3 are identified by the numerals and letters previously used but with primes added thereto. In the third form A-3 of the invention it will be seen that the iron body 58 and magnet H have been eliminated. The prong 56' in the third form A-3 of the invention extends rearwardly through a transverse opening 124 in plate 20' to terminate in a handle. The forward portion of prong 56' extends through a transverse opening 128 in a trigger 130 that is pivotally supported by conventional means from one of the projections 22, and is at all times urged to the angular position shown in FIG. 13. The trigger 130 has a forwardly disposed extension 132 that projects beyond the forward face of block G. The trigger 130 when in the angular position shown in FIG. 14 frictionally binds on the prong 56', and prevents the compressed helical spring 62' moving the prong forwardly. When the third form of the invention A-3 is mounted in an outlet box E, and a sheet of wall board D moved adjacent framing F, the trigger 130 is pivoted inwardly allowing the prong 56' to be driven forwardly to register an indentation 68 on the wall board sheet D to indicate the center of electrical outlet box E. The sheet of wall board E is now moved from the framing F, and the cutter B is employed to form opening C using the identation 68 as a guide in the same manner as previously described in connection with the first form A-1 of the invention.

The use and operation of the inventions have been described previously in detail and need not be repeated.

What is claimed is:

1. A device for registering the center of a framing supported electrical outlet box by an identation on a sheet of wall board when the latter is moved temporarily to the position it will permanently occupy when secured to said framing, said outlet box of the type that includes a back from which a pair of end walls and sidewalls extend forwardly to terminate in a pair of horizontal and vertical edges, said back, end walls and sidewalls cooperating to define a confined space, said device including:

a. a horizontally positionable plate of less length than the width of said confined space and removably disposable in the latter;

b. a pair of laterally spaced projections that extend forwardly from said plate;

c. first and second pairs of legs slidably movable in first and second pairs of vertical openings in said pair of projections, said legs having first ends;

d. first and second grippers supported from said first ends of said first and second pairs of legs;

e. first springs means that tend to move said grippers away from one another into gripping contact with said pair of end walls;

f. a prong that has a pointed forward end;

g. first means between said pair of projections for slidably supporting said prong for movement normal to said plate;

h. second means that tend to maintain said prong in a first position where said pointed end is disposed rearwardly of said pair of projections; and i. third means for moving said prong forwardly for said pointed end to form said indentation on said wall board as a guide to subsequently cut an opening in said wall board in alignment with said outlet box.

2. A device as defined in claim 1, which in addition includes:

j. a magnetically attractable body secured to said prong, and said third means being a magnet that when disposed adjacent said wall board in general alignment with said prong attracts said magnetically attractable body to move said prong forwardly to form said indentation.

3. A device as defined in claim 1 in which said third means is a spring that at all times tends to move said prong forwardly, and said pivotally supported from one of said projections that has an opening therein that bindingly engages said prong when said trigger is in a first position and extends forwardly at an angle relative to said projection from which it is pivotally supported, with said trigger when contacted by said wall board pivoting to a second position where said prong may move relative thereto, to form said indentation in said wall board.

4. A device as defined in claim 1, in which said first and second grippers are first and second rigid blocks that have upper and lower surfaces that contact said end walls, and said first and second blocks including forwardly disposed outwardly projecting transverse ribs that removably engage said horizontal edges of said end walls.

* * * * *